US006733318B2

(12) United States Patent
Myer et al.

(10) Patent No.: US 6,733,318 B2
(45) Date of Patent: May 11, 2004

(54) BOARD-TO-BOARD CONNECTOR ASSEMBLY

(75) Inventors: John Mark Myer, Millersville, PA (US); John Phillip Huss, Jr., Harrisburg, PA (US); Hurley Chester Moll, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/099,250

(22) Filed: Mar. 15, 2002

(65) Prior Publication Data

US 2003/0176094 A1 Sep. 18, 2003

(51) Int. Cl.[7] ..... H01R 13/64
(52) U.S. Cl. ..... 439/248
(58) Field of Search ..... 439/248, 845, 439/79, 246

(56) References Cited

U.S. PATENT DOCUMENTS 6,338,638 B2 * 1/2002 Kodama ..... 439/246
6,491,536 B1 * 12/2002 Torii ..... 439/246

* cited by examiner

*Primary Examiner*—Renee Luebke
*Assistant Examiner*—Ann McCamey

(57) ABSTRACT

An electric connector assembly is provided having a housing with a chamber therein having an open end configured to receive a plug contact. The electric connector assembly includes a receptacle contact having a contact box on one end located in the chamber. The electrical connector has a contact pin on an opposite end extending from the chamber, and the contact box has a latch feature on a periphery thereof securing the contact box to the housing. The contact box has an open front end aligning with the open end of the chamber that is configured to receive a plug contact. The receptacle contact further includes a compliant section between the contact box and contact pin that is flexible to absorb vibrations introduced into the contact box and contact pin.

19 Claims, 6 Drawing Sheets

BOARD-TO-BOARD CONNECTOR ASSEMBLY

BACKGROUND OF THE INVENTION

Certain embodiments of the present invention generally relate to an electrical connector containing axially compliant contacts that electrically connect components such as printed circuit boards.

In certain applications, such as in an automobile, electronic components aligned perpendicularly to each other and separated by a firewall are connected to each other by mateable plug and receptacle housings, also known as a board-to-board connector assembly. The plug and receptacle housings include plug and receptacle contacts, respectively. Each receptacle contact is bent so that a front portion is perpendicular to a rear portion. The receptacle contacts are positioned in the receptacle housing so that the front portions mateably receive the plug contacts, which are connected to a first printed circuit board, and the rear portions are connected to a second printed circuit board that is oriented perpendicular or at an acute angle to the first printed circuit board.

In conventional board-to-board connector assemblies, the front portions of the receptacle contacts are press fit within cavities in the plastic receptacle housing while the rear portions extend exposed down through a base wall of the housing. Because the rear portions are not covered by the receptacle housing and are only retained at the base wall, the rear portions are easily affected by outside forces which may cause the rear portions to vibrate. As the vibrations travel along the receptacle contacts, the vibrations cause the front portions to become loose or distorted within the cavities in the receptacle housing. Thus, constant vibration wears and damages the receptacle housing and the front portions of the receptacle contacts as well as adversely affects the connection with the plug contacts.

Also, because the front portions of the receptacle contacts are press fit within the plastic receptacle housing, the metal front portions of the receptacle contacts have no space for axial expansion due to temperature changes. Thus, as the front portions of the receptacle contacts expand within the cavities, the front portions of the receptacle contacts may become distorted by their contact with cavity walls and push against the cavity walls causing cracks in the receptacle housing, and become disconnected from the plug contacts.

Therefore, a need exists for a board-to-board connector assembly that overcomes the above problems and addresses other concerns experienced in the prior art.

BRIEF SUMMARY OF THE INVENTION

Certain embodiments include an electric connector assembly having a housing with a chamber therein having an open end configured to receive a plug contact. The electric connector assembly includes a receptacle contact having a contact box on one end located in the chamber. The electrical connector has a contact pin on an opposite end extending from the chamber, and the contact box has a latch feature on a periphery thereof securing the contact box to the housing. The contact box has an open front end aligning with the open end of the chamber that is configured to receive a plug contact. The receptacle contact further includes a compliant section between the contact box and contact pin that is flexible to absorb vibrations introduced into the contact box and contact pin.

Figure 1:
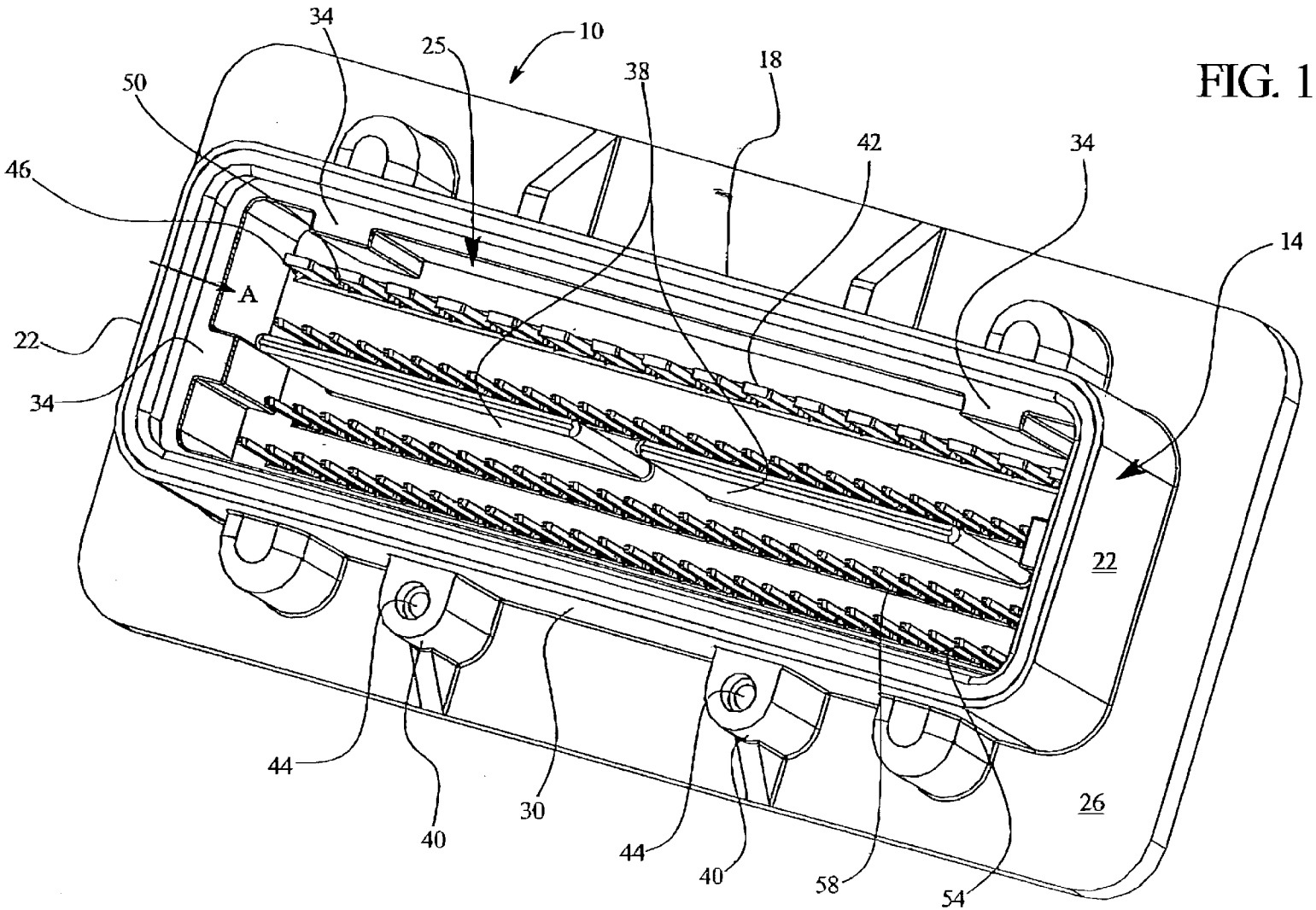
FIG. 1 illustrates a front isometric view of a plug housing formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates a front isometric view of a plug housing 10 formed according to an embodiment of the present invention. The plug housing 10 includes a shroud header 14 formed from a top wall 18, a bottom wall 30 and opposite end walls 22 extending perpendicularly outward from a rear wall 26 that collectively define a chamber 25. Rectangular securing rails 34 extend inward from the top wall 18 proximate opposite ends of the top wall 18. Likewise, a securing rail 34 extends inward from each end wall 22. Planar retention bars 38 extend from the rear wall 26 into the chamber 25 and are suspended within the shroud header 14. Screw blocks 40 extend from the rear wall 26 along the bottom wall 30 and include screw holes 44 that extend through the screw blocks 40 and the rear wall 26. During assembly, screws are inserted into the screw holes 44 and are used to connect the plug housing 10 to a printed circuit board (not shown) or other electronic component. The shroud header 14 mateably receives a contact block 66 (FIG. 2) with the securing rails 34 orienting the contact block 66 within the shroud header 14 and the retention bars 38 aligning the contact block 66 with the shroud header 14 such that contact blades 42 and contact pins 54 are received within the contact block 66 without being bent.

The contact blades 42 extend through the rear wall 26 into the chamber 25 and are aligned in a row proximate and parallel to the top wall 18. The contact blades 42 are retained within rectangular passages 46 extending through the rear wall 26. The contact blades 42 include blade crossbeams 50 that extend outward from opposite sides of the contact blades 42. During assembly, the contact blades 42 are inserted into the passages 46 through the shroud header 14 in the direction of arrow A until the blade crossbeams 50 engage, and are retained in, the passages 46, thus leaving the contact blades 42 suspended within the shroud header 14.

The contact pins 54 are also inserted through the rear wall 26 and are aligned in parallel rows extending along the bottom wall 30. The contact pins 54 also include pin crossbeams 58 that extend outward from, either side of the contact pins 54. During assembly, the contact pins 54 are inserted into the shroud header 14 in the direction of arrow A until the pin crossbeams 58 engage, and are retained in, passages 46 through the rear wall 26, thus leaving the contact pins 54 suspended within the shroud header 14.

When the shroud header 14 mateably engages the contact block 66 (FIG. 2), the contact blades 42 and contact pins 54 are received into the contact block 66 to electrically communicate with receptacle contacts 110 and 162 (FIG. 4), respectively.

Figure 2:
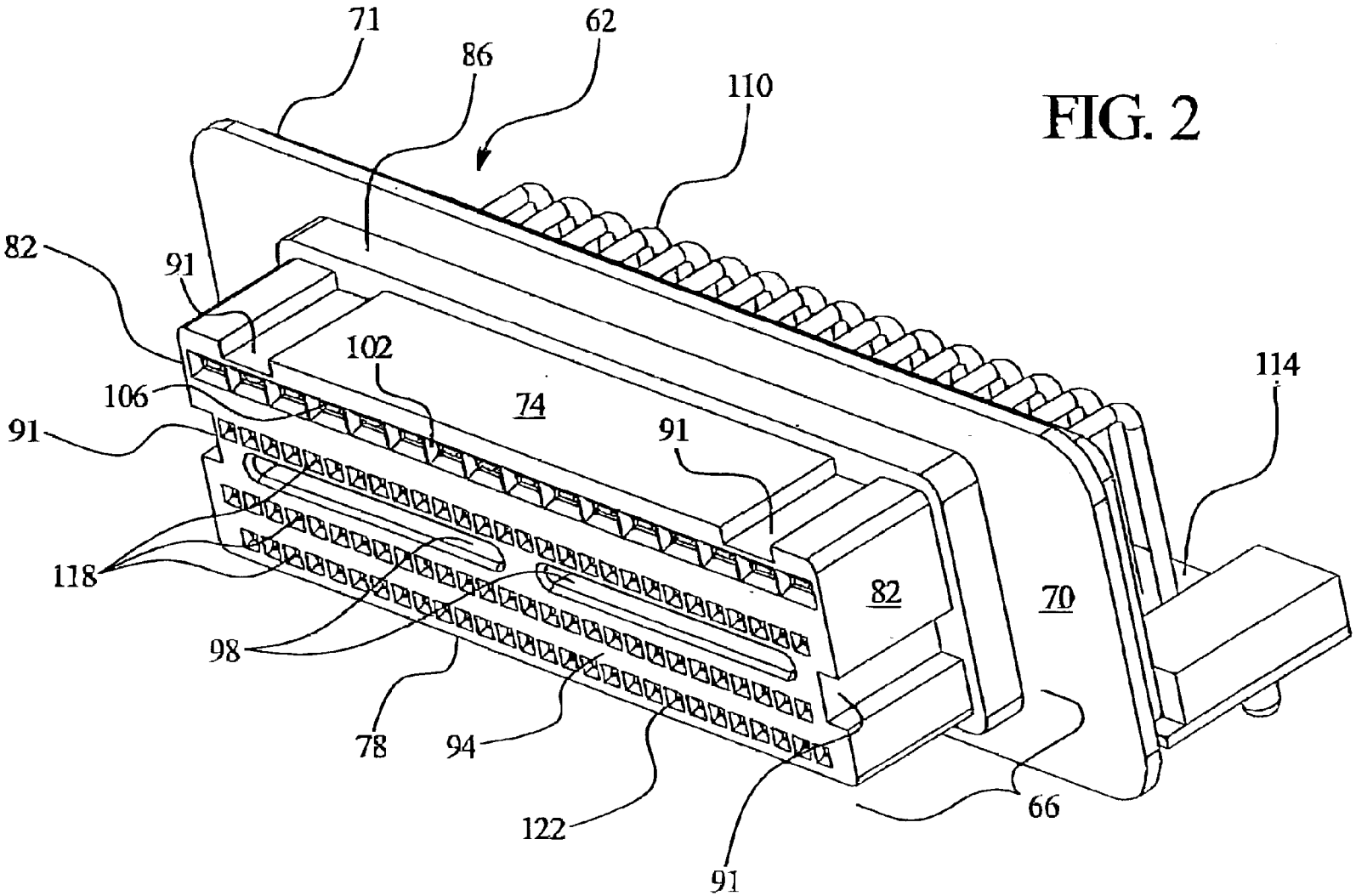
FIG. 2 illustrates a front isometric view of a receptacle housing formed according to an embodiment of the present invention.

FIG. 2 illustrates a front isometric view of a receptacle housing 62 formed according to an embodiment of the present invention. The receptacle housing 62 includes the contact block 66 extending out from a rear wall 70. A bottom wall 114 is formed along one edge of the rear wall 70. The contact block 66 includes a top wall 74, a bottom wall 78 and opposite end walls 82 extending out from a base 86 formed on the rear wall 70. The top wall 74 includes rail channels 91 proximate opposite ends thereof. Each end wall 82 also includes a rail channel 91. The contact block 66 includes a front surface 94 having long thin beam cavities 98 therein. When the plug housing 10 (FIG. 1) and the receptacle housing 62 are mated, the shroud header 14 (FIG. 1) receives the contact block 66. As the shroud header 14 receives the contact block 66, the rail channels 91 in the top wall 74 receive and retain the securing rails 34 (FIG. 1) on the top wall 18, and the rail channels 91 in the end walls 82 receive and retain the securing rails 34 on the end walls 22. Likewise, the beam cavities 98 receive and retain the retention bars 38 (FIG. 1) on the plug housing 10.

The front surface 94 is formed with a plurality of rectangular blade cavities 102 extending therethrough and aligned in a row proximate and parallel to the top wall 74. The blade cavities 102 contain metal contact boxes 106 that form part of the receptacle contacts 110. One end of the receptacle contacts 110 extends through a rear side 71 of the rear wall 70 and into blade cavities 102 in the contact block 66. An opposite end of the receptacle contacts 110 extends down to the bottom wall 114 oriented perpendicular to the rear wall 70. In operation, the row of blade cavities 102 and contact boxes 106 receive corresponding rows of contact blades 42 (FIG. 1) that electrically connect with the receptacle contacts 110 at the contact boxes 106.

Figure 4:
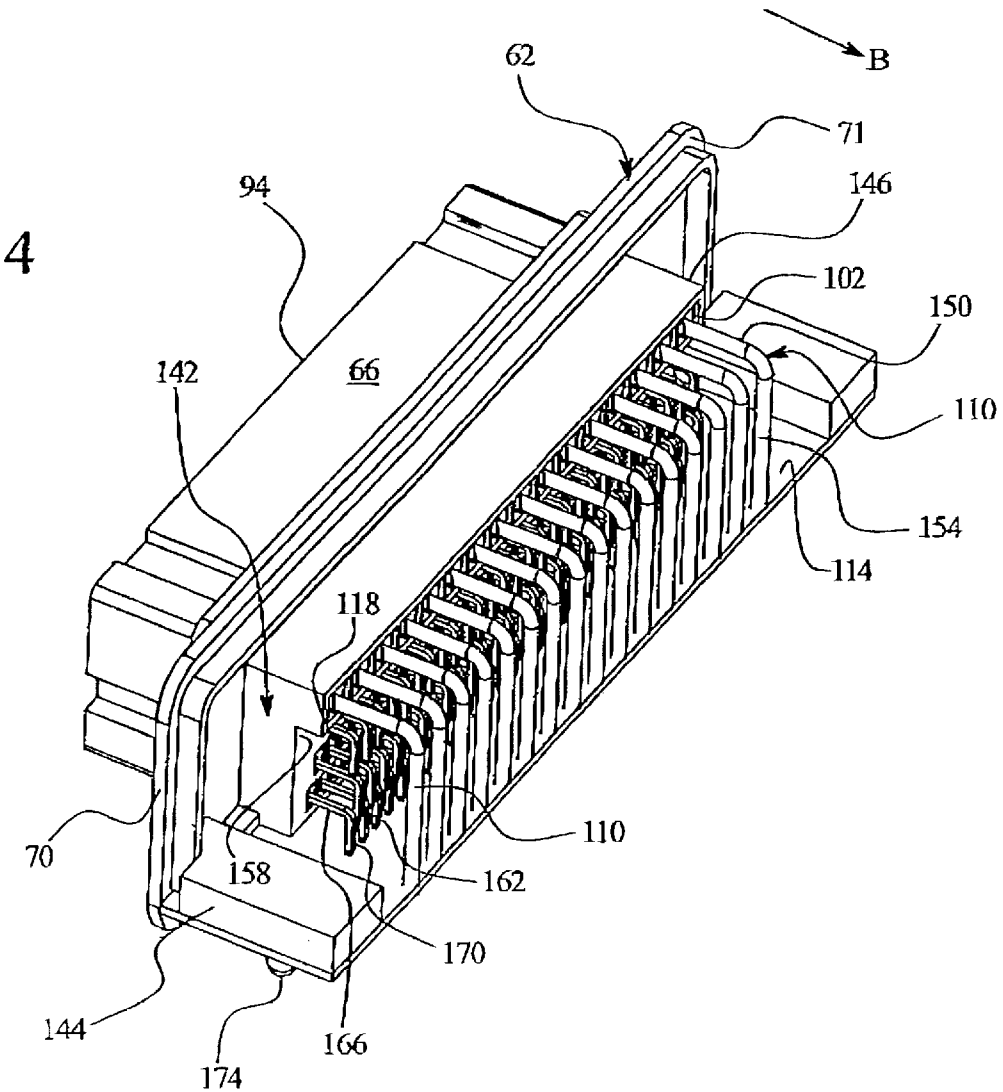
FIG. 4 illustrates a top isometric view of the receptacle housing of FIG. 2.

The front surface 94 of the contact block 66 also includes rectangular pin cavities 118 aligned in parallel rows. The pin cavities 118 contain metal contact boxes 122 formed on ends of receptacle contacts 162 (FIG. 4). One end of the receptacle contacts 162 extends through the rear side 71 of the rear wall 70 into the contact block 66. An opposite end of the receptacle contacts 110 extends down to the bottom wall 114. The pin cavities 118 and contact boxes 122 receive corresponding contact pins 54 (FIG. 1), until the contact pins 54 electrically connect with the receptacle contacts 162 (FIG. 4) through the contact boxes 122.

Figure 3:
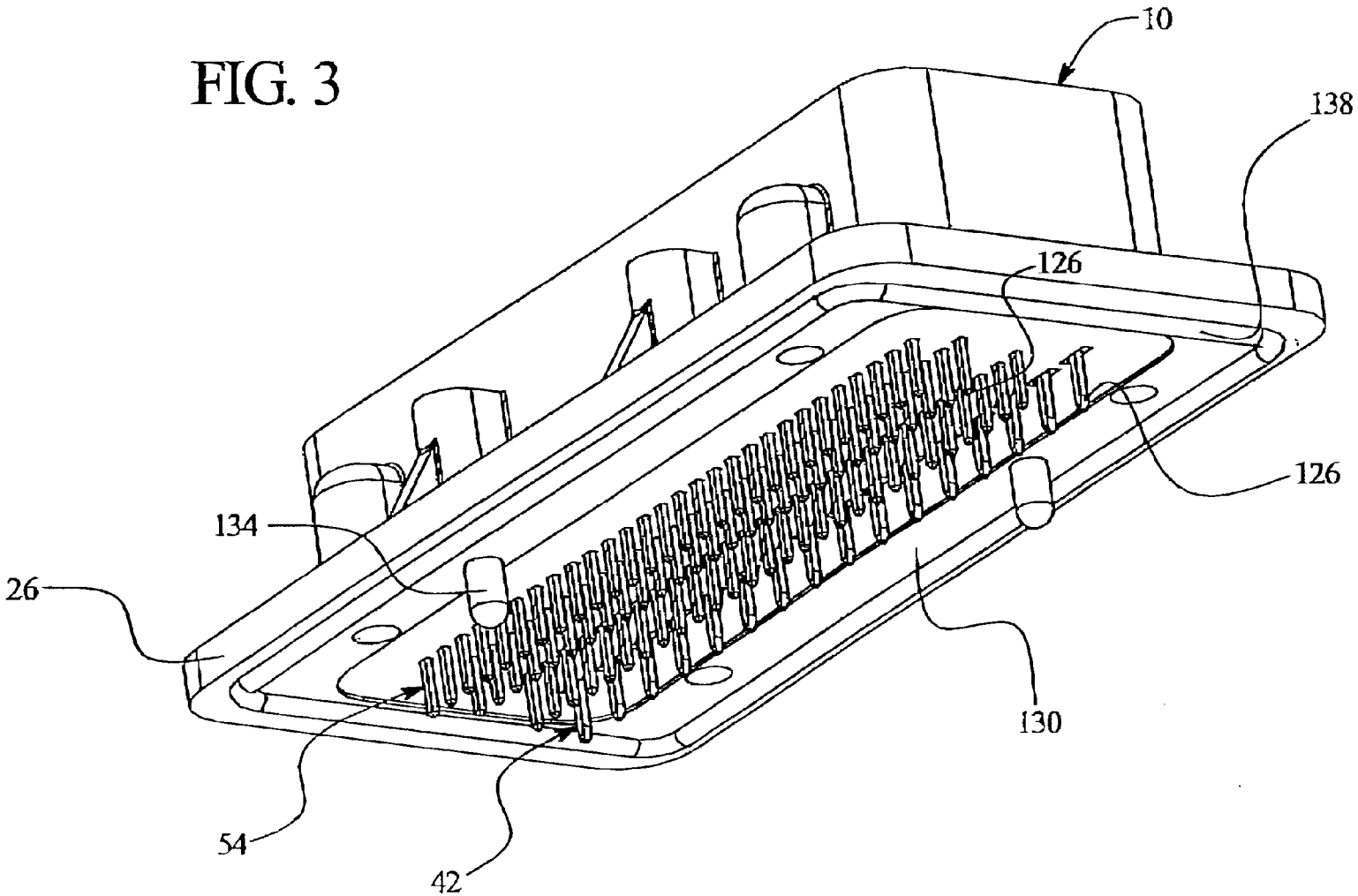
FIG. 3 illustrates a bottom isometric view of the plug housing of FIG. 1.

FIG. 3 illustrates a bottom isometric view of the plug housing 10 of FIG. 1. The contact blades 42 and contact pins 54 include tail ends 126 that extend outward through a bottom surface 130 of the rear wall 26 and are aligned in rows. Board posts 134 extend out from the bottom surface 130 of the rear wall 26, and a rectangular board seal 138 wraps along a peripheral of the bottom surface 130. The tail ends 126 are soldered to the printed circuit board (not shown), and the board posts 134 are received and retained in apertures in the printed circuit board, thus securing the plug housing 10 to the printed circuit board. The board seal 138 forms a seal between the rear wall 26 and the printed circuit board to prevent contaminants from affecting the contact blades 42 and contact pins 54.

FIG. 4 illustrates a top isometric view of the receptacle housing 62 of FIG. 2. Rectangular securing blocks 144 extend outward from the rear wall 70 and are connected to the bottom wall 114. The lower side of the bottom wall 114 includes bottom posts 174. An L-shaped contact chamber 142 extends from the rear side 71 of the rear wall 70 along the bottom wall 114 and includes an overhang block 146. The blade cavities 102 extend from the front surface 94 of the contact block 66 through the rear wall 70 and the overhang block 146. The receptacle contacts 110 include front pin portions 150 and rear pin portions 154. The contact chamber 142 also includes a lower wall 158. The pin cavities 118 extend from the front surface 94 of the contact block 66 through the rear wall 70 and the lower wall 158. The receptacle contacts 162 are smaller than the receptacle contacts 110 and include front pin portions 166 and rear pin portions 170.

During assembly, the receptacle contacts 110 and 162 are unbent and are inserted into the blade cavities 102 and pin cavities 118, respectively, through the front surface 94 in the direction of arrow B. The contact boxes 106 and 122 (FIG. 2) are press fit within the blade and pin cavities 102 and 118, respectively. The front pin portions 150 and 166 extend out of the blade and pin cavities 102 and 118, respectively, of the contact chamber 142. The receptacle contacts 110 and 162 are then bent so that the rear pin portions 154 and 170 are perpendicular to the front pin portions 150 and 166, respectively. The bottom wall 114 has post apertures (not shown) and is fastened to the securing blocks 144 with the post apertures receiving the bottom posts 174. The rear pin portions 154 and 170 extend through holes (not shown) in the bottom wall 114 leaving tail ends 294 (FIG. 5) exposed under the bottom wall 114.

The receptacle housing 62 is positioned on a printed circuit board (not shown) with the bottom posts 174 being received and retained in apertures in the printed circuit board. The tail ends 294 (FIG. 5) of the receptacle contacts 110 and 162 are soldered to the printed circuit board. The receptacle housing 62 is then mated with the plug housing 10 (FIG. 1) so that electric signals are sent from the printed circuit board attached to the receptacle housing 62 to the printed circuit board attached to the plug housing 10, and vice versa.

Figure 5:
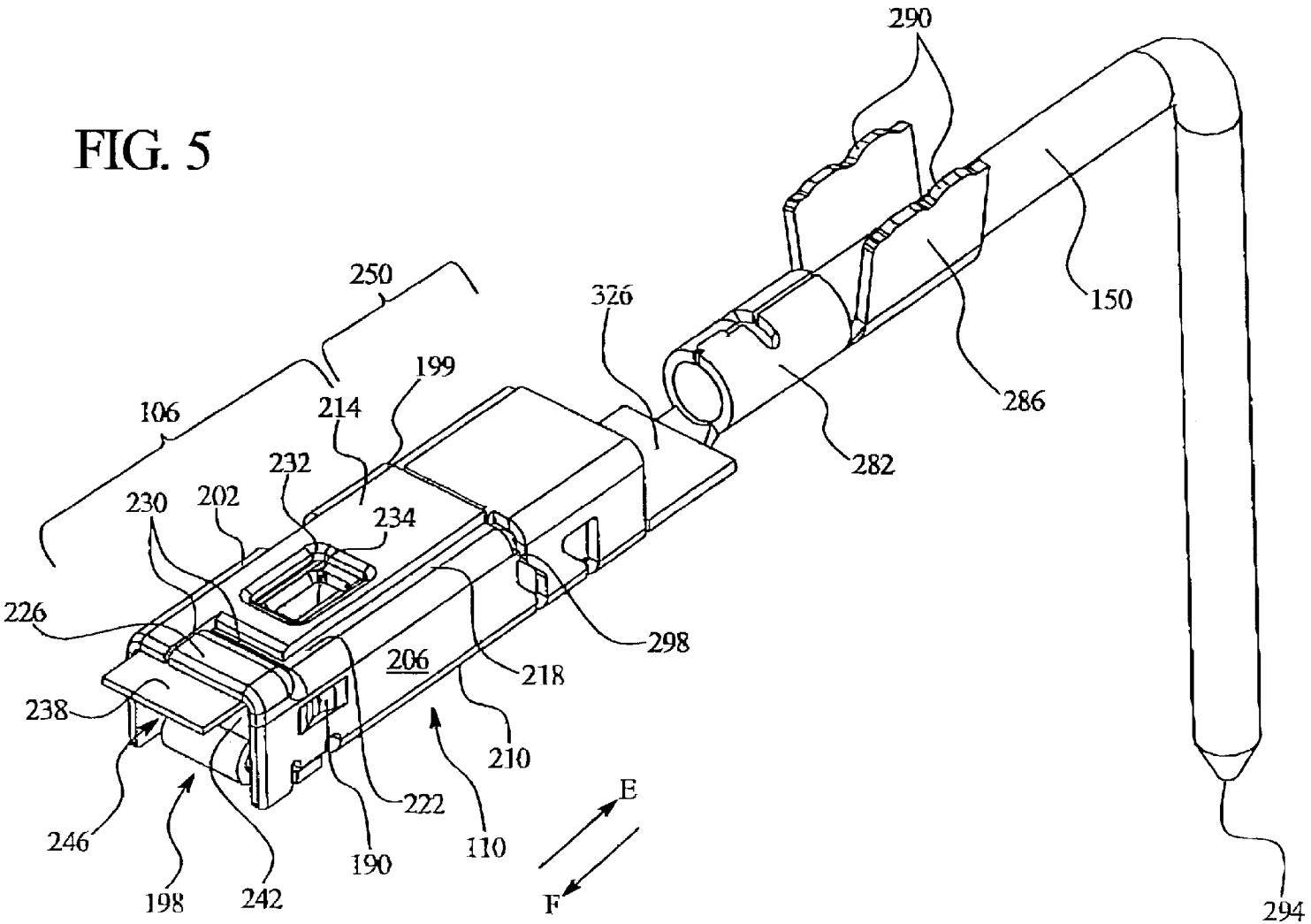
FIG. 5 illustrates a side isometric view of a receptacle contact formed according to an embodiment of the present invention.

FIG. 5 illustrates a side isometric view of a receptacle contact 110. The receptacle contact 110 is similar in structure to the receptacle contact 162 (FIG. 4), but different in size. The receptacle contact 110 is generally representative of the receptacle contact 162 and thus only the receptacle contact 110 is discussed in detail. The receptacle contact 110 includes the contact box 106 situated at a front end 198 of the receptacle contact 110. The contact box 106 includes opposite side walls 202 and 206 extending upward from a bottom wall 210. The side walls 202 and 206 are formed integral with top walls 214 and 222, respectively. The top walls 214 and 222 are bent toward one another in an overlapping arrangement. A front portion 226 of the top wall 222 extends inward from the side wall 206 and is separated from the top wall 214 by gaps 230. The front portion 226 of the top wall 222 is flared upward to be aligned in a common horizontal plane 238 with the top wall 214.

The overlapping top walls 214 and 222 include overlapping apertures 232 and 234, respectively, located generally in the centers thereof. The apertures 232 and 234 receive a latch (not shown) extending downward and into the apertures 232 and 234 from an interior surface of a top wall in the blade cavity 102 (FIG. 4). The latch extends through the apertures 232 and 234 to hold the contact box 106 in a fixed position within the blade cavity 102. The latch prevents the top wall 214 and a rear portion 218 of the top wall 222 from sliding relative to each other. The overlapping top walls 214 and 222 reinforce the structural integrity of the contact box 106 in order to better withstand pressures applied to the contact box 106 by the walls of the blade cavity 102 and by engagement with contact blades 42 (FIG. 1).

A spring prong 242 is formed integral with and extends from the bottom wall 210 at the front end 198. The spring prong 242 is bent at an acute angle rearward into a contact cavity 246 and projects toward the top walls 214 and 222. When the blade cavity 102 receives a contact blade 42 (FIG. 1), the contact blade 42 enters the contact box 106 at the front end 198 in the direction of arrow E. As the contact blade 42 enters the contact box 106, the contact blade 42 slides up along the spring prong 242 until the contact blade 42 is pinched between the spring prong 242 and the top wall 222. The contact blade 42 is thus held in a fixed position in the contact box 106 and may be slidably removed when pulled out of the contact box 106 in the direction of arrow F.

The side walls 202 and 206 include retention recesses 190 that engage catches (not shown) extending inward from interior side walls in the blade cavity 102 as the receptacle contact 110 is inserted into the blade cavity 102. The catches and retention recesses 190 cooperate to retain the contact box 106 within the blade cavity 102 in a fixed position. Stop beams 298 are formed on and extend rearward from rear ends 199 of the side walls 202 and 206. The stop beams 298 engage and resist a compliant section 250 when the compliant section 250 shifts toward the contact box 106, thus preventing the compliant section 250 from damaging or dislodging the contact box 106.

A connection board 326 extends rearward from the compliant section 250 to a cylindrical pin holder 282. The pin holder 282 is crimped about the front pin portion 150 proximate a first end to form a mechanical weld. The pin holder 282 secures the front pin portion 150 to the compliant section 250 so that an electric signal is conveyed between the contact box 106 and the tail end 294. A U-shaped retention flange 286 is wrapped around the front pin portion 150 proximate the pin holder 282. When the receptacle contact 110 is positioned within the blade cavity 102 (FIG. 4), ridged surfaces 290 of the retention flange 286 frictionally engage an interior top wall (not shown) of the blade cavity 102 within the overhang block 146 (FIG. 4) and retain the receptacle contact 110 within the blade cavity 102.

Figure 6:
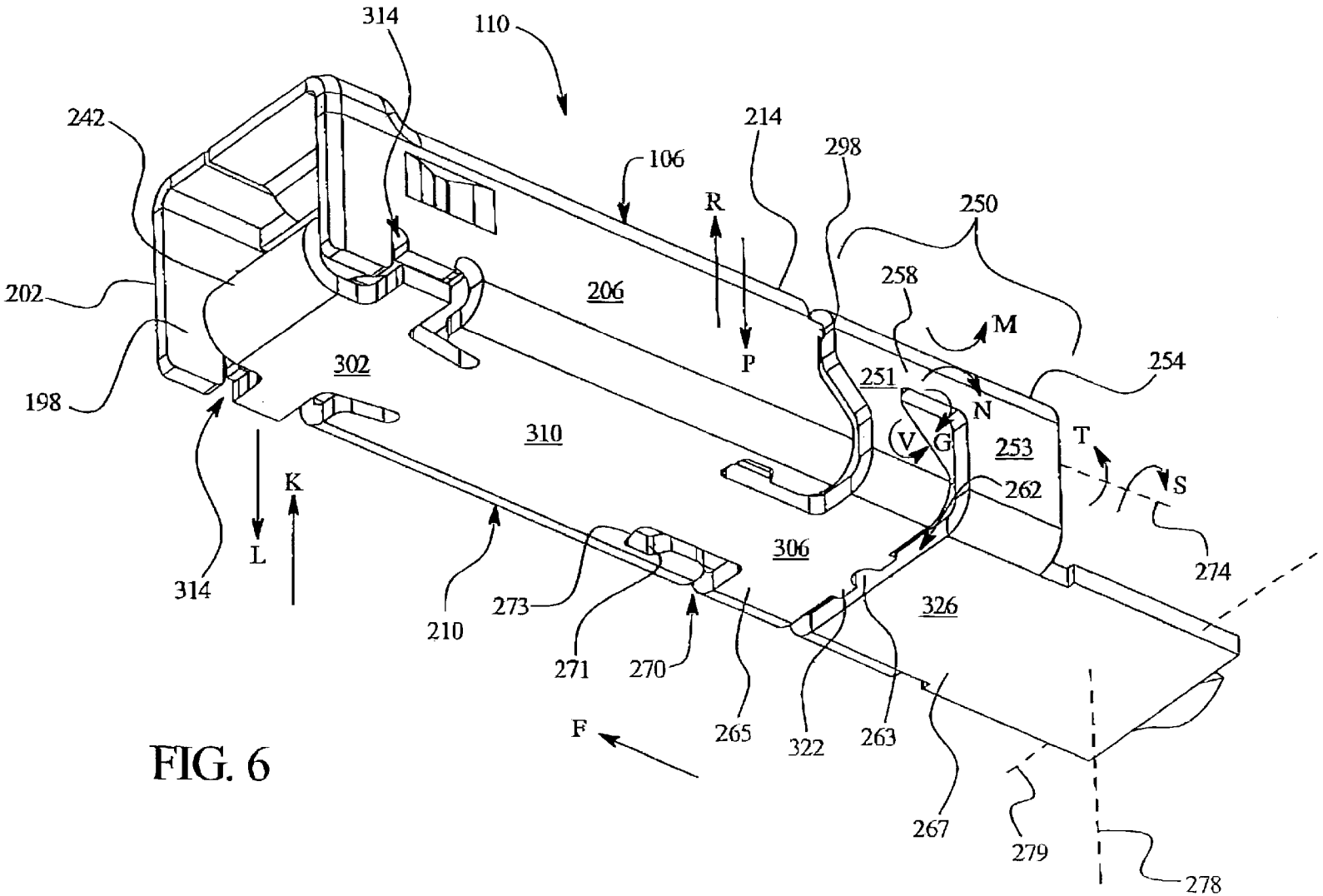
FIG. 6 illustrates a bottom isometric view of the receptacle contact of FIG. 5.

FIG. 6 illustrates a bottom isometric view of the receptacle contact 110 of FIG. 5. The bottom wall 210 includes a cross portion 302 extending from one end of an intermediate portion 310 and a cross portion 306 extending from the opposite end of the intermediate portion 310. The cross portion 302 is separated from the side walls 202 and 206 by bottom gaps 314. The bottom gaps 314 allow the cross portion 302 to be biased in the directions of arrow K or arrow L as the contact blade 42 (FIG. 1) enters the contact box 106 and engages the spring prong 242. Thus, the bottom gaps 314 allow for easier insertion of the blade contact 42.

The compliant section 250 is connected to the bottom wall 210 of the receptacle contact 110 and includes side walls 258 having leading side sections 251 extending from a cross portion 306 of the bottom wall 210 to a top wall 254 of the compliant section 250. The compliant section 250 is formed at one end integral with the bottom wall 210 of the contact box 106 and at an opposite end integral with the connection board 326. Side notches 262 separate the leading side sections 251 from trailing side sections 253. The bottom wall 210 of the compliant section 250 is also divided by a bottom gap 263 into lead and trailing bottom sections 265 and 267, respectively. The lead bottom section 265 includes a plurality of stop projections 322 extending toward the trailing bottom section 267 within the bottom gap 263. The compliant section 250 is separated from the contact box 106 by a contact gap 270 that extends across the top wall 214 and downward along the side walls 202 and 206 along a diagonal line in a general S-shape. The contact gap 270 includes lower lead gap sections 271 extending parallel to one another along the bottom wall 210. The lower lead gap sections 271 are directed forward toward the front end 198 of the contact box 106 and are flared at ends 273 (FIG. 6).

In operation, the compliant section 250 allows vibrations traveling along the receptacle contact 110 from the front and rear pin portions 150 and 154 (FIG. 4) to be absorbed without dislodging or damaging the contact box 106 press fitted within the blade cavity 102 (FIG. 4). For example, when vibrations caused by external forces affecting the front pin portion 150 (FIG. 4) travel along the receptacle contact 110 in the direction of arrow F, the trailing side sections 253 extend in the direction of F into the side notches 262 and bottom gap such that the stop projections 322 may engage the connection board 326. The vibrations are partially absorbed by the stop projections 322 and the side notches 262 before reaching the leading side sections 251. As the vibrations travel along the leading side sections 251, the leading side sections 251 and top wall 254 axially float in the direction of arrow F into the contact gap 270. The contact gap 270 thus narrows. The leading side sections 251 may contact the stop beams 298, however even then the vibrations are greatly reduced and do not dislodge or damage the contact box 106. The contact gap 270 allows the compliant section 250 to float in either direction along a longitudinal axis 274 that extends along the length of the contact box 106, and in either direction along transverse axes 278 and 279 that extends perpendicular to the length of the contact box 106.

For example, as the connection board 326 floats along the transverse axis 278 in the direction of arrow K, the side walls 258 flex in the direction of arrow M proximate the side notches 262. Alternatively, as the connection board 326 floats along the transverse axis 278 in the direction of arrow L, the side walls 258 flex in the direction of arrow N proximate the side notches 262. Similarly, as the cross portion 306 floats along the transverse axis 278 in the direction of arrow K, the bottom wall 210 flexes in the direction of arrow M proximate the ends 273 of the lower lead gap sections 271. Alternatively, as the cross portion 306 floats along the transverse axis 278 in the direction of arrow L, the bottom wall 210 flexes in the direction of arrow N proximate the ends 273 of the lower lead gap sections 271.

Likewise, as the connection board 326 floats along the transverse axis 279 in the direction of arrow P, the side walls 258 flex in the direction of arrow Q proximate the side notches 262. Alternatively, as the connection board 326 floats along the transverse axis 279 in the direction of arrow R, the side walls 258 flex in the direction of arrow V proximate the side notches 262. Additionally, as the leading side sections 251 float along the transverse axis 279 in the direction of arrow P, the cross portion 306 flexes in the direction of arrow Q between the lower lead gaps 271. Alternatively, as the leading side sections 251 float along the transverse axis 279 in the direction of arrow R, the cross portion 306 flexes in the direction of arrow V between the lower lead gaps 271.

The side notches 262 and contact gap 270 similarly accommodate axial float of the compliant section 250 stemming from thermal expansion. For example, as the metal of the compliant section 250 expands, the compliant section 250 axially floats toward the contact box 106 in the direction of arrow F, narrowing the contact gap 270, but not contacting the contact box 106.

Additionally, the side notches 262 and bottom gap 263 accommodate the twisting of the trailing side sections 253 and connection board 326 about the longitudinal axis 274. For example, as the connection board 326 or trailing side sections 253 are twisted in the direction of either arrow T or S about the longitudinal axis 274, the top wall 254 and trailing side section 253 flex in the same direction proximate the side notches 262. Likewise, the contact gap 270 and the lower lead gap sections 271 accommodate the twisting of the compliant section 250 about the longitudinal axis 274. For example, as the compliant section 250 is twisted in the direction of either arrow T or S about the longitudinal axis 274, the cross portion 306 flex in the same direction between the lower lead gap sections 271. Thus, vibrations causing the connection board 326 or compliant section 250 to twist are accommodated without affecting the contact box 106.

The receptacle housing confers the benefit of an axially floating receptacle contact. When the compliant section receives vibrations from the pin portions or expands due to temperature changes, the compliant section may move axially within the blade cavity into gaps separating the compliant section from the contact box. Thus vibrations and thermal expansion are less likely to loosen or damage the contact boxes or affect the electrical connection between the contact boxes and the contact blades or pins.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly comprising:

a housing having a chamber therein, said chamber including an open end configured to receive a plug contact;

a receptacle contact including a contact box on one end located in said chamber and a contact pin on an opposite end extending from said chamber, said contact box having a latch feature on a periphery thereof securing said contact box to said housing, said contact box having an open front end aligning with said open end of said chamber and being configured to receive a plug contact, said receptacle contact further including a compliant section between said contact box and contact pin, said compliant section being flexible to absorb vibrations introduced into said contact box and contact pin, wherein said compliant section includes side walls with a notch formed therein dividing said side walls into lead and rear wall portions, said notch permitting relative motion between said lead and rear wall portions to absorb vibrations.

2. The electrical connector of claim 1, wherein said compliant section and contact box are joined by a common wall that flexes to absorb vibrations.

3. The electrical connector of claim 1, wherein said compliant section and contact box are separated by a gap that narrows and widens to absorb vibrations.

4. The electrical connector of claim 1, wherein said compliant section and contact box are joined by a common wall that twists about a longitudinal axis to absorb vibrations.

5. The electrical connector of claim 1, wherein said compliant section includes a lead bottom wall joined to said contact box and a trailing bottom wall joined to said contact pin, said lead bottom wall and trailing bottom wall being divided by a gap that narrows and widens to absorb vibrations.

6. The electrical connector of claim 1, wherein said compliant section includes side walls with a notch formed therein dividing said side walls into lead and rear wall portions joined along a top wall, said top wall twisting about a longitudinal axis to absorb vibrations.

7. The electrical connector of claim 1, wherein said compliant section and contact box are separated by a gap that narrows and widens to absorb vibrations, said contact box having stop beams extending into said gap, said stop beams resisting and absorbing contact from said compliant section.

8. The electrical connector of claim 1, wherein said compliant section includes a lead bottom wall joined to said contact box and a trailing bottom wall joined to said contact pin, said lead bottom wall and trailing bottom wall divided by a gap, said lead and trailing bottom walls flexing along a vertical axis to absorb vibrations.

9. An electrical connector assembly comprising:

a housing having a contact block that mateably receives a second housing having a shroud header, said contact block having a cavity configured to receive a plug contact extending into said shroud header at a first end of said cavity;

a receptacle contact including a contact box on one end located in said cavity at said first end and a contact pin on an opposite end extending from said cavity at a second end, said contact box being frictionally retained in said cavity and having an open front end aligning with said first end of said cavity configured to receive said plug contact, said receptacle contact further including a compliant section between said contact box and contact pin, said compliant section being flexible to absorb vibrations introduced into said contact box and contact pin;

wherein said compliant section and contact box are separated by a gap that narrows and widens to absorb vibrations, said contact box having stop beams extending into said gap, said stop beams resisting and absorbing contact from said compliant section.

10. The electrical connector of claim 9, wherein said compliant section includes side walls with a notch formed therein dividing said side walls into lead and rear wall portions, said notch permitting relative motion between said lead and rear wall portions to absorb vibrations.

11. The electrical connector of claim 9, wherein said compliant section and contact box are joined by a common wall that flexes to absorb vibrations.

12. The electrical connector of claim 9, wherein said compliant section and contact box are separated by a gap that narrows and widens to absorb vibrations.

13. The electrical connector of claim 9, wherein said compliant section and contact box are joined by a common wall that twists about a longitudinal axis to absorb vibrations.

14. The electrical connector of claim 9, wherein said compliant section includes a lead bottom wall joined to said contact box and a trailing bottom wall joined to said contact pin, said lead bottom wall and trailing bottom wall being divided by a gap that narrows and widens to absorb vibrations.

15. The electrical connector of claim 9, wherein said compliant section includes side walls with a notch formed therein dividing said side walls into lead and rear wall portions joined along a top wall, said top wall twisting about a longitudinal axis to absorb vibrations.

16. The electrical connector of claim 9, wherein said compliant section includes a lead bottom wall joined to said contact box and a trailing bottom wall joined to said contact pin, said lead bottom wall and trailing bottom wall being divided by a gap that narrows and widens to absorb vibrations, said lead bottom wall having stop projections extending into said gap, said stop projections resisting and absorbing contact from said trailing bottom wall.

17. The electrical connector of claim 9, wherein said compliant section includes a lead bottom wall joined to said contact box and a trailing bottom wall joined to said contact pin, said lead bottom wall and trailing bottom wall divided by a gap, said lead and trailing bottom walls flexing along a vertical axis to absorb vibrations.

18. An electrical connector assembly comprising:

a housing having a chamber therein, said chamber including an open end configured to receive a plug contact;

a receptacle contact including a contact box on one end located in said chamber and a contact pin on an opposite end extending from said chamber, said contact box having a latch feature on a periphery thereof securing said contact box to said housing, said contact box having an open front end aligning with said open end of said chamber and being configured to receive a plug contact, said receptacle contact further including a compliant section between said contact box and contact pin, said compliant section being flexible to absorb vibrations introduced into said contact box and contact pin;

wherein said compliant section and contact box are separated by a gap that narrows and widens to absorb vibrations, said contact box having stop beams extending into said gap, said stop beams resisting and absorbing contact from said compliant section.

19. The electrical connector of claim 18, wherein said compliant section includes a lead bottom wall joined to said contact box and a trailing bottom wall joined to said contact pin, said lead bottom wall and trailing bottom wall being divided by a gap that narrows and widens to absorb vibrations, said lead bottom wall having stop projections extending into said gap, said stop projections resisting and absorbing contact from said trailing bottom wall.

* * * * *